US011209185B2

(12) United States Patent
Williams et al.

(10) Patent No.: US 11,209,185 B2
(45) Date of Patent: Dec. 28, 2021

(54) VENTILATION AND DRYING SYSTEM AND METHOD OF USING THE SAME

(71) Applicants: Arch Williams, Cary, NC (US); Benjamin C. Dunlap, Charlotte, NC (US)

(72) Inventors: Arch Williams, Cary, NC (US); Benjamin C. Dunlap, Charlotte, NC (US)

( * ) Notice: Subject to any disclaimer, the term of this patent is extended or adjusted under 35 U.S.C. 154(b) by 204 days.

(21) Appl. No.: 16/587,718

(22) Filed: Sep. 30, 2019

(65) Prior Publication Data

US 2020/0025406 A1 Jan. 23, 2020

Related U.S. Application Data

(63) Continuation of application No. 15/326,360, filed as application No. PCT/US2014/046889 on Jul. 16, 2014, now Pat. No. 10,436,471.

(51) Int. Cl.
*F24F 7/06* (2006.01)
*F24F 11/74* (2018.01)
(Continued)

(52) U.S. Cl.
CPC ..... *F24F 11/74* (2018.01); *F24F 7/06* (2013.01); *F24F 11/0001* (2013.01);
(Continued)

(58) Field of Classification Search
CPC ..... F24F 2007/002; F24F 7/06; F24F 3/14; F26B 21/06; F26B 21/001
(Continued)

(56) References Cited

U.S. PATENT DOCUMENTS 3,004,484 A 10/1961 Lorenz
3,401,621 A 9/1968 Aaberg
(Continued)

FOREIGN PATENT DOCUMENTS

EP 2416637 2/2012
JP 04240495 A 8/1992
(Continued)

OTHER PUBLICATIONS

International Search Report, PCT/US2014/046889, dated Jan. 22, 2015.

*Primary Examiner* — Vivek K Shirsat
*Assistant Examiner* — Ko-Wei Lin
(74) *Attorney, Agent, or Firm* — Womble Bond Dickinson (US) LLP

(57) ABSTRACT

An air handling system includes a housing, a blower, a sensor, an air intake valve, and a controller. The housing includes an outlet to a passenger compartment, a fresh air inlet providing fresh air into the housing and a recirculated air inlet that guides air flow from the passenger compartment into the housing. The blower moves air through the housing. The air intake valve moves between a closed position blocking air flow from the fresh air inlet into the housing and an open position unblocking air flow from the fresh air inlet into the housing. The controller positions the air intake valve relative to the fresh air inlet controlling the flow of fresh air into the housing and thereby maintaining moisture density of the air flow entering the passenger compartment within a prescribed range based on humidity and temperature values from the sensor.

20 Claims, 4 Drawing Sheets

(51) Int. Cl.

| | |
|---|---|
| ***F24F 11/72*** | (2018.01) |
| ***F24F 11/00*** | (2018.01) |
| ***F24F 11/30*** | (2018.01) |
| ***F26B 5/00*** | (2006.01) |
| ***F26B 21/12*** | (2006.01) |
| *F24F 7/00* | (2021.01) |
| *F24F 110/20* | (2018.01) |

(52) U.S. Cl.
CPC ..... *F24F 11/30* (2018.01); *F24F 11/72* (2018.01); *F26B 5/00* (2013.01); *F26B 21/12* (2013.01); *F24F 2007/001* (2013.01); *F24F 2110/20* (2018.01)

(58) Field of Classification Search
USPC ..... 454/228, 229, 239, 251–253
See application file for complete search history.

(56) References Cited

U.S. PATENT DOCUMENTS

| | | | | |
|---|---|---|---|---|
| 5,000,079 | A * | 3/1991 | Mardis | F04D 29/663 361/695 |
| 5,904,896 | A * | 5/1999 | High | F24F 9/00 422/4 |
| 6,779,735 | B1 | 8/2004 | Onstoff | |
| 6,796,896 | B2 | 9/2004 | Laiti | |
| 7,188,485 | B2 | 3/2007 | Szpekman | |
| 7,434,413 | B2 * | 10/2008 | Wruck | 62/126 |
| 8,202,146 | B1 | 6/2012 | Johnson et al. | |
| 10,436,471 | B2 | 10/2019 | Williams et al. | |
| 2008/0073439 | A1 * | 3/2008 | Lestage | F24F 11/0001 236/44 A |
| 2008/0182506 | A1 | 7/2008 | Jackson et al. | |
| 2010/0024106 | A1 * | 2/2010 | Katsumi | F24D 5/12 4/213 |
| 2011/0308265 | A1 | 12/2011 | Phannavong et al. | |
| 2012/0028560 | A1 | 2/2012 | Zivota | |
| 2012/0227280 | A1 * | 9/2012 | Hopkin | F26B 3/04 34/492 |
| 2013/0052929 | A1 * | 2/2013 | Eisenhour | B60H 1/00849 454/75 |

FOREIGN PATENT DOCUMENTS

| | | | |
|---|---|---|---|
| JP | 09112993 | A * | 5/1997 |
| JP | 9112993 | A | 5/1997 |
| JP | 2005308304 | A | 11/2005 |
| JP | 2008220732 | A | 9/2008 |
| JP | 2013057474 | | 3/2013 |
| KR | 101195525 | | 10/2012 |
| KR | 20130025419 | | 3/2013 |

* cited by examiner

VENTILATION AND DRYING SYSTEM AND METHOD OF USING THE SAME

CROSS-REFERENCE TO RELATED APPLICATIONS

This application is a continuation of U.S. patent application Ser. No. 15/326,360, filed Jan. 13, 2017, which is a 371 national stage application of International Application PCT/US14/46889, filed Jul. 16, 2014. The entire contents of each of the above applications are hereby incorporated by reference.

FIELD OF INVENTION

The present disclosure relates to ventilation systems providing improvements in evacuation efficiency. In some embodiments, the ventilation systems are adapted to improve drying of wet or humid areas such as residential bathrooms.

BACKGROUND OF THE INVENTION

Bathrooms are often equipped with evacuation fans. When turning on these fans, they attempt to pull air from the bathroom and exhaust air from the bathroom out to the exterior of the building. These evacuation fans are designed to remove foul air from the room. Foul air can be noxious air or may be humid air or steam created during a hot shower.

Evacuation fans presently on the market are classified based upon factors such as airflow rate/volume, fan/motor size, noise, integrated lighting options, and integrated heating options. The present disclosure provides a ventilation system that improves upon the function of these known fans.

SUMMARY

When conventional evacuation fans are put to actual use, there is a significant drop in performance compared to the maximum potential for a given fan size, motor speed and evacuation area. When installed in enclosures, such as bathrooms, conventional evacuation fans have a tendency to create a negative pressure within the enclosed space, hampering the ability of the evacuation fan to exhaust air from the enclosure. Therefore, one aspect of the present disclosure is to provide a ventilation system that mitigates the negative pressure buildup within the evacuated space, allowing an evacuation system to perform much more efficiently with respect to air removal. This reduces the amount of time the system needs to operate, which may also provide energy savings.

Another aspect of the disclosed ventilation system is that the system can improve drying time of the enclosed space by being able to not only function as an air evacuation system but also act as an air recirculation system. By combining the ability to evacuate and recirculate air, the ventilation system disclosed herein improves the drying time of an enclosed space, helping to improve safety by limiting the presence of wet, slippery surfaces, and helping to improve health and cleanliness by reducing the factors that lead to growth of bacteria, mold, mildew, fungus, and other allergens.

Some embodiments of the present disclosure include an air circulation and ventilation system for an enclosure. The system may have a housing defining a manifold. The housing can include a first intake aperture configured to receive air from within the enclosure, a first outlet aperture configured to emit air from the manifold to outside the enclosure, and a fan configured to draw air in through the first intake aperture. The system also includes a port configured to allow additional air into the enclosure, including a port damper for selectively opening and closing the port. A switch operably coupled to the fan and the port damper is also included in the system. The switch provides a first state where the port damper is closed and the fan is off, and a second state where the port damper is open and the fan is on.

Other embodiments of the present disclosure include a method of drying a wet surface in an enclosure. The method includes providing a manifold, the manifold having an inlet, a first outlet, an outlet damper coupled with the first outlet, a second outlet, and a fan. The method further includes positioning the manifold such that the fan is capable of pulling air from the enclosure into the manifold through the inlet, emitting air to the environment through the first outlet when the outlet damper is open and emitting air back into the enclosure through the second outlet when the outlet damper is closed. The method continues by providing a port having a port damper, positioning the port to allow air to enter the enclosure from the environment, and providing a switch operably coupled to the fan, the outlet damper, and the port damper. The drying method is conducted by operating the elements in a first state with the fan moving, the outlet damper open, and the port damper open to evacuate humid air through the first outlet and draw in less humid air from the environment through the port, then operating the elements in a second state with the fan moving, the outlet damper closed and the port damper closed. The switch is used to cycle repeatedly between the first state and second state until the enclosure is sufficiently dry.

Some other embodiments of the present disclosure include a method of evacuating air from an enclosure. The method includes providing the preferred elements, which include: an air inlet into the enclosure, an air outlet out of the enclosure, a damper to selectively open and close the air inlet, a fan to selectively pull air through the air outlet, and a switch operatively coupled to both the damper and the fan. The evacuation of air then proceeds by operating the switch to selectively open the damper and turn on the fan substantially simultaneously.

These and other objects and advantages of the present invention will be more apparent from the following detailed description and the accompanying figures.

BRIEF DESCRIPTION OF THE DRAWINGS

In the following, reference is made to the accompanying drawings, which are not necessarily drawn to scale and may be schematic. The drawings are exemplary only, and should not be construed as limiting the inventions.

DETAILED DESCRIPTION

Exemplary embodiments are described below and illustrated in the accompanying drawings, in which like numerals refer to like parts throughout the several views. The embodiments described provide examples and should not be interpreted as limiting the scope of the inventions.

Figure 1:
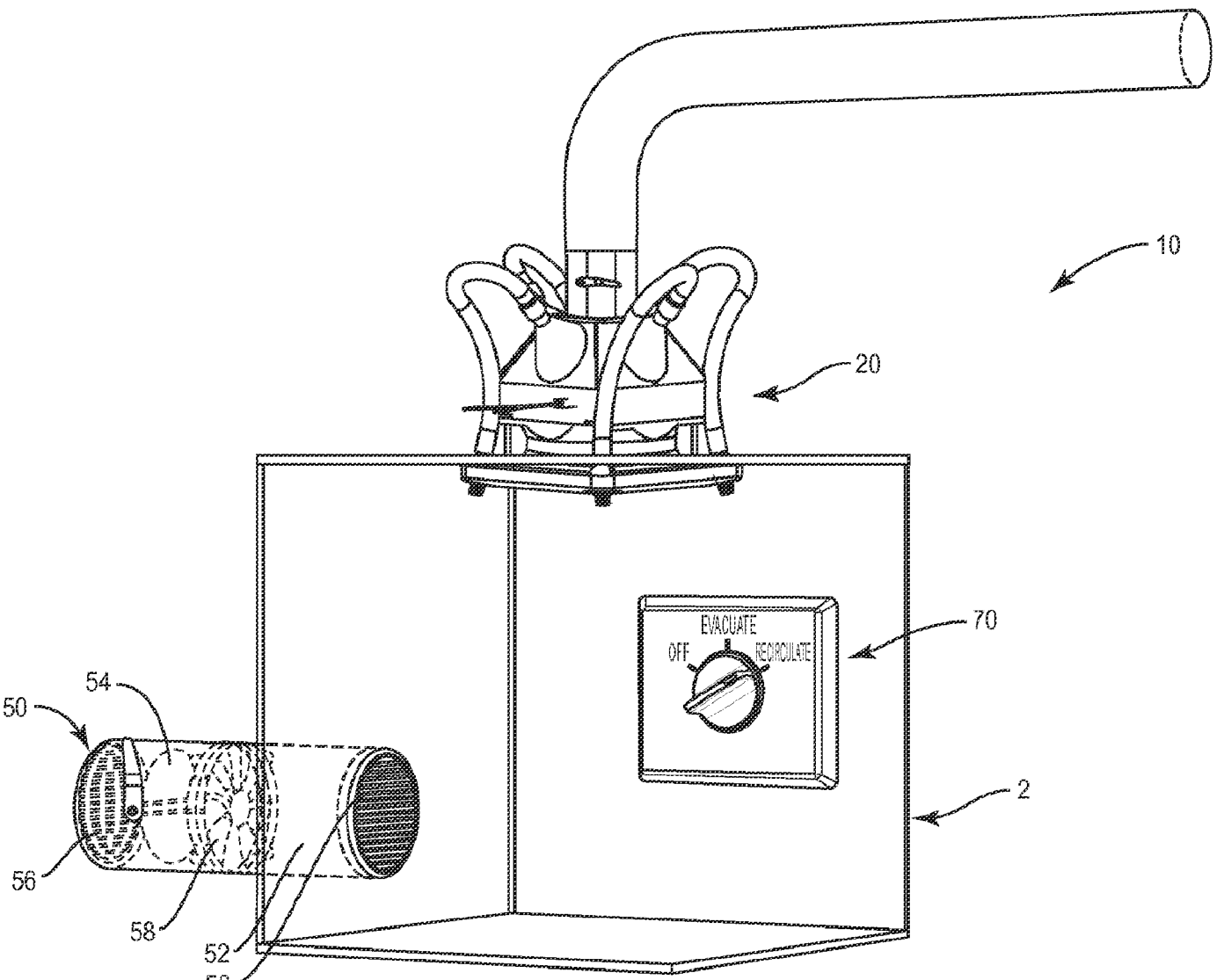
FIG. 1 shows a system according to the present disclosure in an off configuration.

Turning to the figures, FIG. 1 shows an air circulation and ventilation system 10 in relation to a generally enclosed space or enclosure 2 such as a residential bathroom. A bathroom is a preferred example of an enclosure 2 for which the ventilation system 10 may be employed because, when in use by a person, the door or doors for entrance and egress of the person are generally maintained in a closed position, substantially enclosing the room. It is understood that a bathroom with doors closed is not a completely air-tight box, but should still be considered enclosed because of the minimal area for flow of air into and out of the space. A bathroom is a preferred example of an enclosure 2 because of the increased likelihood for having foul air that should be ventilated or because of the likelihood for humid air created by a shower. While a bathroom is one preferred example, workshops, smoking lounges or any number of other relatively enclosed spaces may benefit from the ventilation system 10 of the present disclosure.

The ventilation system 10 can be considered as combining three sub-systems: a fan assembly sub-system 20, a pressure equalization sub-system 50, and a switching sub-system 70 operably coupled to the fan assembly sub-system 20 and the pressure equalization sub-system 50.

Fan Assembly Sub-System

Figure 4:
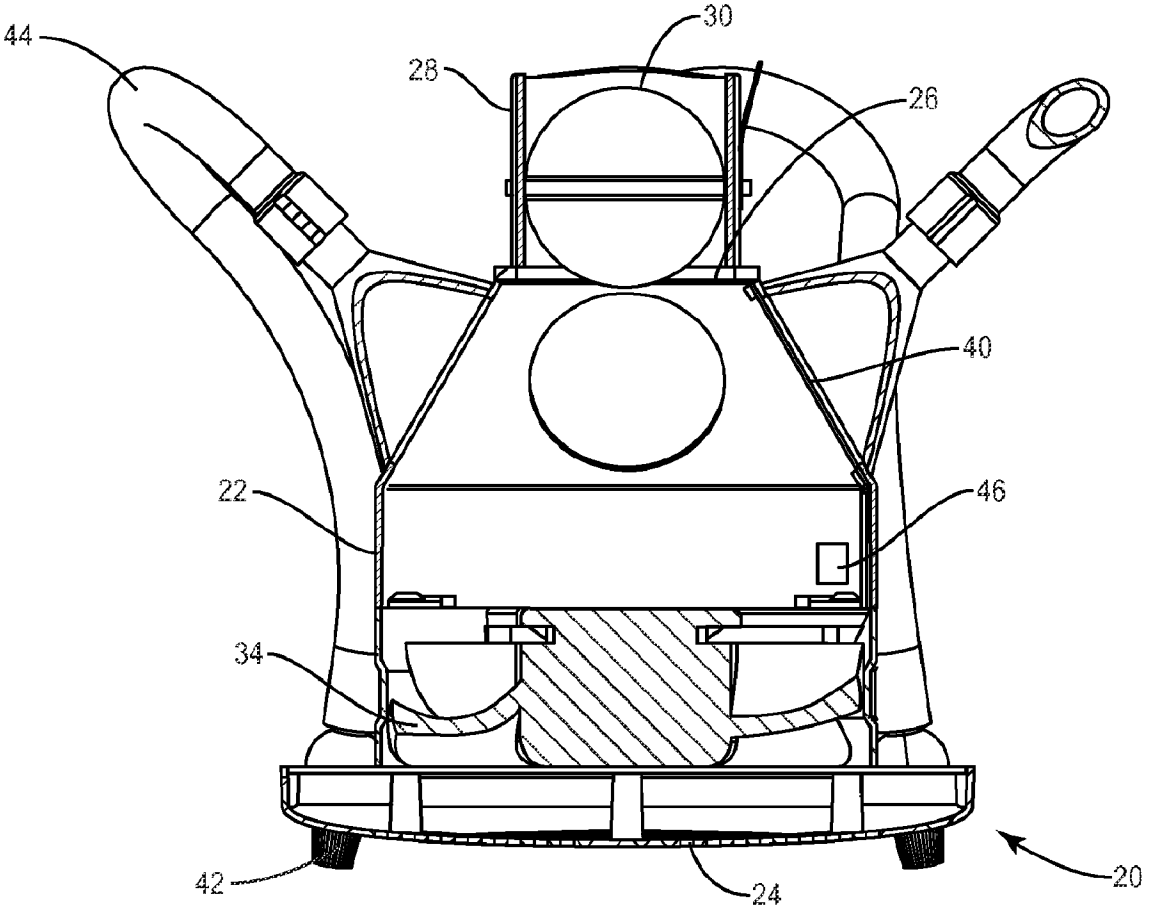
FIG. 4 shows a cross section of the fan assembly subsystem shown in FIG. 1.

As best seen in FIG. 4, the fan assembly sub-system 20 includes a housing 22 defining a manifold. The housing 22 includes an intake aperture 24 for receiving air from the enclosure 2 into the housing 22. The housing 22 also includes an evacuation outlet 26 through which air may flow from the manifold out into the environment. As seen in FIG. 1, the evacuation outlet 26 may be the entrance to a flue or chimney 28 for guiding air away from the housing 22.

An outlet damper 30 is positioned in fluid communication with the evacuation outlet 26 to selectively open and close the evacuation outlet 26, thereby controlling the ability of air to flow through the evacuation outlet 26. The outlet damper 30 is understood to include any suitable means known in the art for selectively restricting flow through an opening. The outlet damper 30 is also understood to include any suitable actuator for selectively operating the flow restriction means.

A fan 34 is positioned within the housing 22 and adjacent to the intake aperture 24. The fan 34 should be considered inclusive of a turbine or blade and a motor for selectively rotating the blade. The fan 34, when operating (i.e. the motor energized to rotate the blade) is configured in one embodiment to cause air to be pulled from the enclosure 2 through the intake aperture 24 and into the manifold.

The housing 22 also includes one or more recirculation outlets 40. In the illustrated embodiment of FIG. 4, four recirculation outlets 40 are shown. The recirculation outlets 40 are configured to emit air from the housing 22 back into the enclosure 2.

In the illustrated embodiment of FIG. 4, the intake aperture 24, the fan 34, and the evacuation outlet 26 are aligned such that air pulled by the fan 34 through the intake aperture 24 is directed along a rotation axis of the fan 34 toward the evacuation outlet 26. While the air pulled into the housing 22 prefers to continue through the evacuation outlet 26, having the outlet damper 30 in a closed or partially closed position can result in some or all of the air in the housing 22 being redirected through the recirculation outlets 40.

As seen in FIG. 4, the recirculation outlets 40 may be fitted with nozzles 42 to direct the air exiting the recirculation outlets 40 in a preferred direction. While nozzles 42 are illustrated, any other structures capable of directing the flow of air may be used as well. Such structures include, but are not necessarily limited to, louvers, baffles, grates, and grills. The nozzles 42 or any of the similar suitable structures for imparting directionality to the flow of air through the recirculation outlets 40 may be either fixed or adjustable as to their direction. Preferably, the flow of air from the recirculation outlets 40 can be directed toward walls or surfaces that are most likely to be wet, thereby helping to increase drying rates and decrease drying times. Adjustability may also be preferred so that the direction can be determined after the installation of the fan assembly sub-system 20.

In the embodiment of FIG. 4, conduits 44 are provided for capturing air flowing toward the top of the housing 22 and turning the flow back to and through the nozzles 42. The conduits 44 pass outside of the manifold defined within the housing 22, but this configuration is an example only. The conduits 44 could also pass inside the manifold, or partially inside and partially outside the manifold. Further, the inside of the manifold may be provided with any number of additional flow diverters, baffles or similar structures to turn air flowing into the housing through intake aperture 24 into air flowing back into the enclosure 2 through the recirculation outlets 40 when the outlet damper 30 is closed. For example, when the conduits 44 and nozzles 42 are not present, the recirculation outlets 40 may be positioned along the bottom of the housing 22.

In some embodiments, the fan assembly sub-system 20 can include an air conditioner 46 configured to condition the foul air within the housing 22. The air conditioner 46 can be an atomizer configured to convert a liquid into a mist, such as a spray nozzle or aerosol nozzle. The air conditioner 46 can also, for example, be a vaporizer configured to release molecules from a liquid or solid using heat. The air conditioner 46 can condition the air by mixing the foul air with conditioning agents such as disinfectants, antimicrobial agents, deodorizers, air fresheners, neutralizers, cleaning agents, and the like. By conditioning the air, particularly recirculated air, potential for and growth rate of mold, mildew, and bacteria can be reduced and/or the air can simply be more pleasant to breathe with a pleasing scent added.

In some embodiments, the fan assembly sub-system 20 does not include any additional dedicated heaters or dehumidifiers to aid in the adjustment of the humidity level of the enclosure or aid drying through the introduction of heat. Providing a fan assembly sub-system 20 without additional heaters and dehumidifiers keeps down the costs associated with manufacturing the fan assembly sub-system 20.

The fan assembly sub-system 20 is configured to operate in at least three modes: (1) an idle mode with the fan 34 off (the outlet damper 30 may be open or closed) (see FIG. 1); (2) an evacuation mode with the fan 34 on and the outlet damper 30 open, resulting in air being pulled from the enclosure 2 and evacuated through the evacuation outlet 26 to the environment (see FIG. 2 with flow arrows); and (3) a recirculation mode with the fan 34 on and the outlet damper 30 closed, resulting in air being pulled from the enclosure 2 and recirculated back into the enclosure 2 through the recirculation outlets 40 (see FIG. 3 with flow arrows).

In embodiments having the air conditioner 46, the air conditioner 46 would preferably be operable, i.e. powered, only in the recirculation mode of the fan assembly sub-system 20. This would prevent the unnecessary release of the conditioning agents into the air that is being evacuated anyway. In other words, the air conditioner 46 conditions the air being recirculated prior to that air being emitted from the recirculation outlets 40.

Pressure Equalization Sub-System

Figure 2:
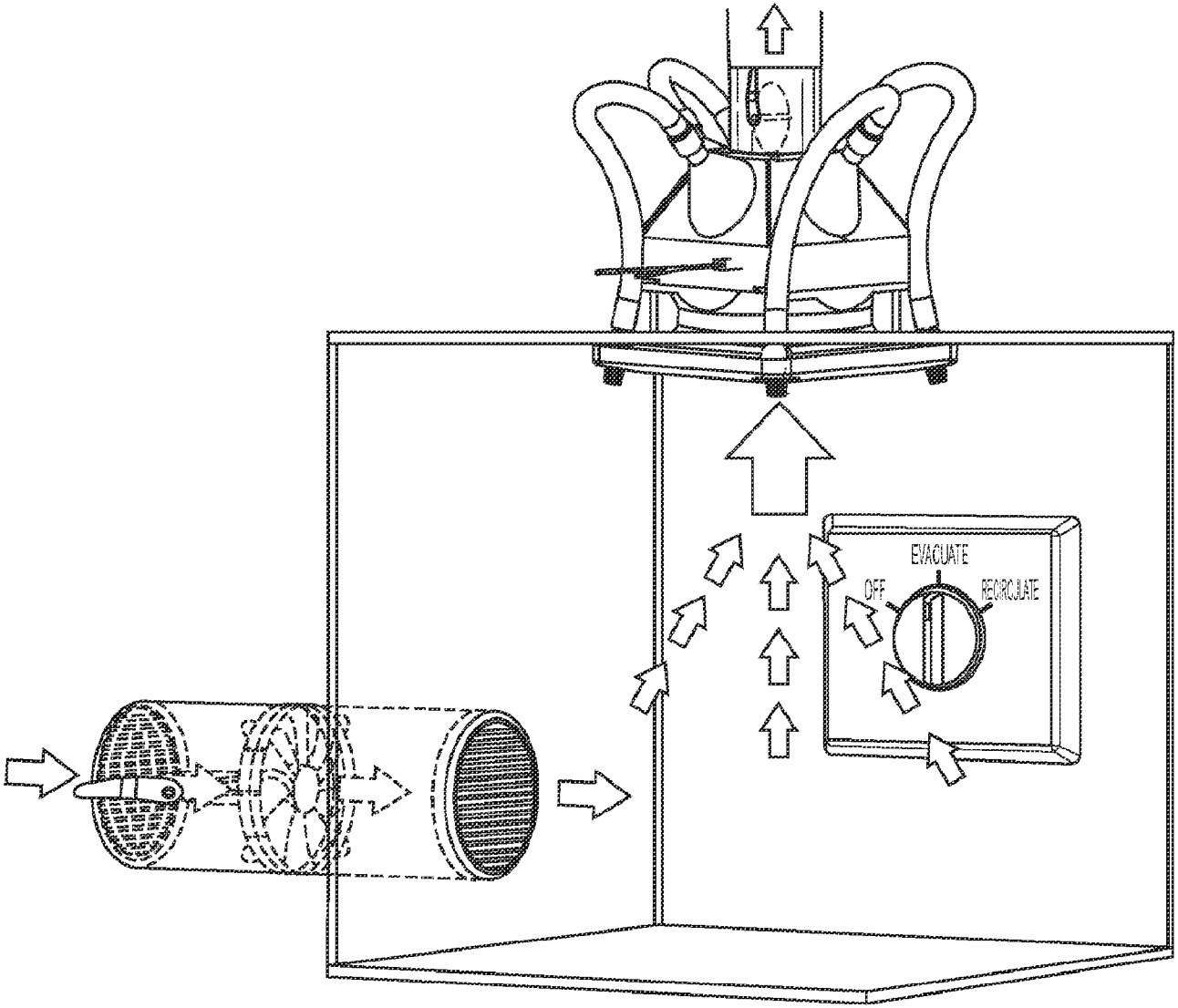
FIG. 2 shows the system of FIG. 1 in an air evacuation configuration.
Figure 3:
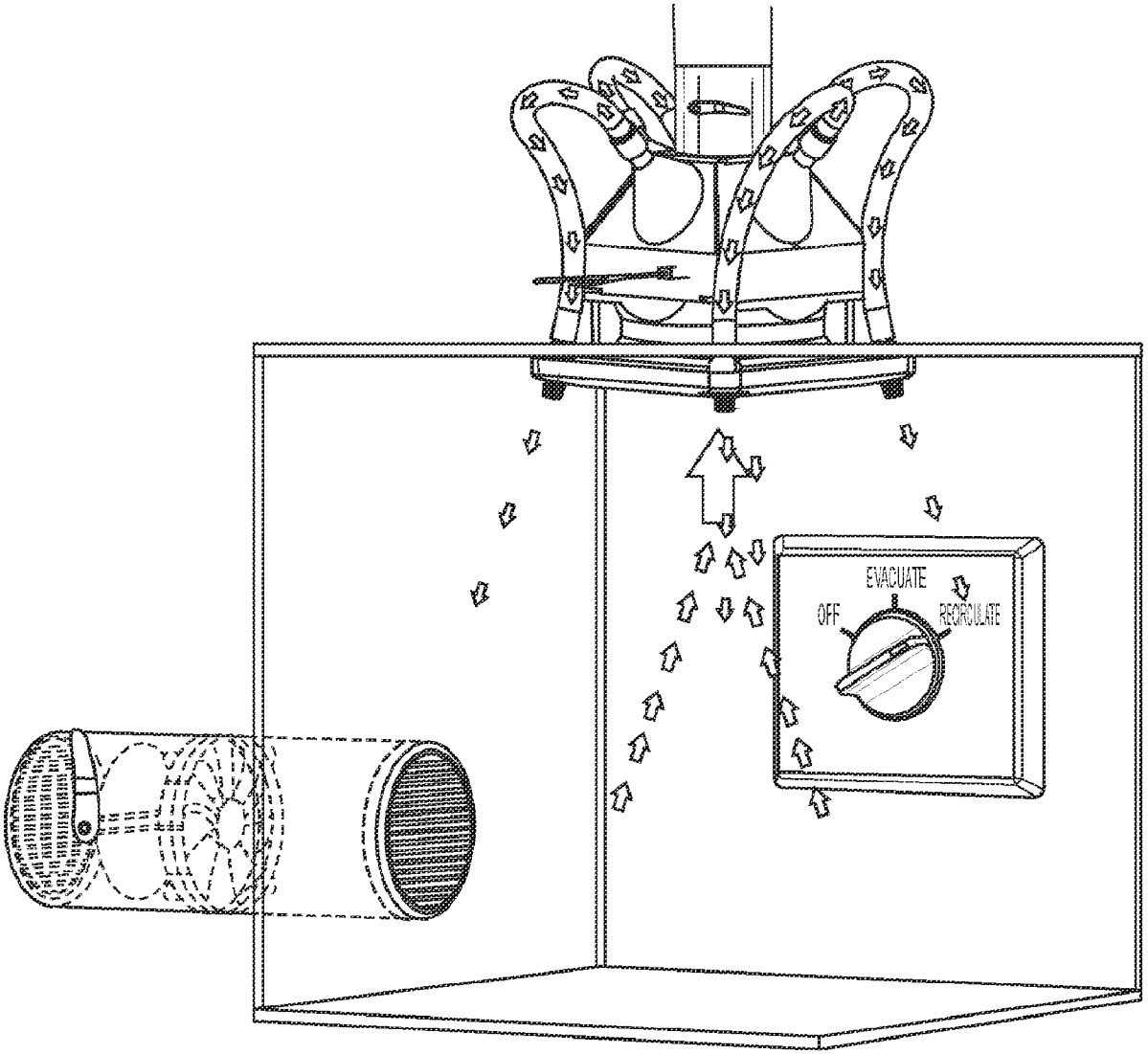
FIG. 3 shows the system of FIG. 1 in an air recirculation configuration.

When operating the fan assembly sub-system 20 in the evacuation mode, the evacuation of air from the enclosure can cause a negative pressure to build within the enclosure 2 and hamper the ability for the fan 34 to force air out into the environment. This is caused by the limited ability for new air to enter into a substantially enclosed space. To minimize the creation of a pressure vacuum within the enclosure 2, the inventors have developed the pressure equalization sub-system 50 as shown in FIGS. 1-3. The pressure equalization sub-system 50 includes a port 52 (or duct) leading from an adjacent room or the exterior of the building into the enclosure 2, for example, through a shared interior wall. The port 52 may be replaced by a plurality of smaller openings, but the total area of the port 52 is generally equal to or greater than the area of the evacuation outlet 26 in one embodiment of the ventilation system 10.

The pressure equalization sub-system 50 further comprises an adjustable port damper 54. Where multiple ports 52 are used, a port damper 54 should be provided for each port 52. The collective total area of the openings of damped ports 52 meets or exceeds the total area of the opening of the evacuation outlet 26 in one embodiment of the ventilation system 10. Thus, inadvertent openings into the enclosure 2, such as HVAC vents or gaps beneath doors should not be considered ports for purposes of this disclosure. The port damper 54, like the outlet damper 30, should be considered inclusive of some suitable means known in the art for selectively restricting flow through an opening and a suitable actuator for selectively operating the flow restriction means.

As seen in FIG. 1, the pressure equalization sub-system 50 can also include a pair of louvered grates 56 on each end of the port 52. The grates 56 provide added privacy and avoid allowing someone to see clearly through the port 52. In addition, if the port 52 leads to the exterior of a structure, the louvered grates 56 prevent objects or animals from entering the enclosure. The louvers of grates 56 may be fixed, manually adjustable or electrically adjustable.

The port damper 54 provides the pressure equalization sub-system 50 with an open mode where air is able generally able to flow through the port 52 and a closed mode where air is generally prohibited from flowing through the port. Note that the port damper 54 does not need to provide an airtight seal within the port 52, nor does the outlet damper 30 need to provide an airtight seal across the evacuation outlet 26.

In some embodiments, a port fan 58 may be positioned adjacent to the port 52 to actively draw air into the enclosure 2 when the port damper 54 is in the open position.

In the open mode, the pressure equalization sub-system 50 is capable of allowing air into the enclosure 2 to equalize the pressure within the enclosure 2 while the fan assembly sub-system 20 is operating in the evacuation mode (see FIG. 2). In the closed mode, the pressure equalization sub-system 50 provides privacy by closing off an opening into the enclosure 2 and prevents unwanted addition of air into the enclosure (see FIG. 3). Preferably, the pressure equalization sub-system 50 is used in the closed mode while the fan assembly sub-system operates in the idle and recirculation modes.

Switching Sub-System

A switching sub-system 70 is operably connected between the fan assembly sub-system 20 and the pressure equalization sub-system 50 to facilitate operation of the ventilation system 10. Particularly, the switching sub-system 70 is capable of controlling the fan 34, the outlet damper 30, the port damper 54 as well as a port fan 58 and air conditioner 46, if present. The switching sub-system 70 is configured to provide a first state where the fan assembly sub-system 20 is in idle mode while the pressure equalization sub-system 50 is in the closed mode. The switching sub-system 70 is configured to provide a second state where the fan assembly sub-system 20 is in the evacuation mode while the pressure equalization sub-system 50 is in the open mode. The switching sub-system 70 is configured to provide a third state where the fan assembly sub-system 20 is in the recirculation mode while the pressure equalization sub-system 50 is in the closed mode.

In the third state provided by the switching sub-system 70, the air conditioner 46 is triggered to condition the air. The air conditioner 46 is likely not to condition the air during the first and second states provided by the switching sub-system 70. This configuration is preferred because it is desirable to have the conditioned air recirculated into the enclosure 2. It is not preferred in most cases to have the conditioning agent mixed with foul air that is simply being evacuated from the enclosure 2 as provided in the second state. While the air conditioner 46 could be somewhat effective in the idle state of the fan assembly 20, the efficiency would be limited. The air conditioner 46 may be triggered by the switching sub-system 70 in a various ways depending on the mechanism used, i.e. turning on a heating element or emitting a spray from an atomizer. The spray from an atomizer can be controlled to function intermittently using a timer function incorporated into the switching sub-system 70 or the air conditioner 46.

The switching sub-system 70 may be described as having at least a three-position switch, one position for each of the three states discussed above, and a controller for selecting the position of the switch. The controller may take a variety of forms. For example, the controller may be a manual knob or lever allowing for manual selection of the state of the switching sub-system 70. In other embodiments, a manual knob or lever may be used in combination with automated controllers, thereby providing, in effect, a manual override. In other examples, the controller may be an automated controller. The automated controller may comprise a programmed processor programmed to alternate between states of the ventilation system 10 in a predetermined fashion, such as running a ventilation cycle at the same time each day when it is expected the homeowner is showering for work.

The controller may include other timers to cycle between states based on duration, for example alternating between the second and third states for 5 minutes per state for a total of an hour after which the ventilation system returns to the first, idle state. This course of timed use could be triggered to begin by a manual switch operated by a person just prior to beginning their shower, for example.

In other embodiments, the ventilation system 10 may be fully automated by using a controller comprising a humidity sensor. The humidity sensor would be operatively coupled to the switch. The humidity sensor could be mounted in a switch-housing on a wall, could sample humidity from the enclosure 2 or from the manifold. Several known technologies exist for sensing humidity, either absolute humidity measuring the water content of air, or relative humidity which compares the water content to the maximum for a given temperature. Humidity sensors are known to function based on measured capacitive properties, resistivity, and thermal conductivity.

A controller with a humidity sensor may trigger initial evacuation (second state) upon sensing of a first absolute or relative humidity. The controller may then trigger a change from evacuation to recirculation (third state) after the humidity level drops to a lower second threshold. The controller may then trigger a change back to evacuation after sensing a humidity level above a third threshold which may be equal to the first. The controller can then trigger a change to idle (first state) after a set time, after the ventilation system 10 fails to jump between states two and three in a given period, or after the humidity level drops below a fourth, lowest humidity.

The humidity sensor may not have a fixed threshold for beginning the use of the fan 34 (switching from state one to states two or three), but instead may test for a quick spike in humidity level indicative of hot shower being taken within the enclosure.

Method of Evacuating Air

Based on the foregoing, the use of the ventilation system 10 in the evacuation state can be described based upon the following set of method steps: (a) providing the enclosure 2 with an air inlet such as port 52; (b) providing the enclosure 2 with an air outlet such as fan assembly intake aperture 24; (c) providing a damper, such as port damper 54, to selectively open and close the air inlet; (d) providing a fan 34 to selectively pull air through the air outlet; (e) providing a switch operatively coupled to both the port damper 54 and the fan 34; and (f) operating the switch to selectively open the port damper and turn on the fan 34 substantially simultaneously. To cease evacuation of air, the switching subsystem is operated to close the port damper 54 and turn off the fan 34 substantially simultaneously.

Method of Drying a Wet Surface within an Enclosure

Based on the foregoing, use of the ventilation system 10 described in the present disclosure can facilitate a method for improving the drying time of a wet surface within an enclosure 2, such as a bathroom after a shower has been run.

In some embodiments, the method begins with the provision of the structural elements of the ventilation system 10, including providing a manifold defined within a housing 22. The manifold has an inlet, a first outlet, an outlet damper 30 coupled with the first outlet, a second outlet and a fan 34, likely electric. The fan 34 must be positioned relative to the enclosure 2 such that the fan 34 is capable of pulling air from the enclosure 2 into the manifold through the inlet, emitting air to the environment through the first outlet when the outlet damper is open and emitting air back into the enclosure through the second outlet when the outlet damper is closed. Additionally, a port 52 is provided, the port 52 having a port damper 54. The port 52 is positioned to allow air to enter the enclosure from the environment, such as an adjacent room. A switch is also provided that is operably coupled to the fan 34, the outlet damper and the port damper 54. When the ventilation system 10 has been provided and positioned relative to the enclosure 2, the act of drying, specifically accelerating the rate of drying, begins by operating the ventilation system 10 in a first state with the fan moving, the outlet damper open, and the port damper open to evacuate humid air through the first outlet and draw in less humid air from the environment through the port. The ventilation system 10 is then operated in a second state with the fan moving, the outlet damper closed and the port damper closed. The switch is used to cycle repeatedly between the first state and second state until the enclosure's surfaces are sufficiently and acceptably dry.

As discussed above, the switching sub-system 70 can include a controller having several embodiments, each providing for a slightly different method of its use. For example, the step of using the switch to cycle between the first state and the second state may include use of a timer to change between states at a predetermined rate. Alternatively, the step of using the switch to cycle between the first state and the second state may include use of a humidity sensor to change between states at based upon humidity level or changes thereto.

Also as discussed above, the recirculation outlet(s) 40 may include means for directing the flow of air therefrom, for example pointed nozzles or fixed or adjustable louvers. Use of these means for directing the flow of air provides another feature of the operation of the ventilation system in the recirculation state, particularly the step of directing air emitted from the second outlet to provide air movement over and around the wet surface areas.

The method described above improves drying time, i.e. accelerates the rate of drying, by increasing the movement of air. Further, directing the recirculated air towards the wet surfaces increases the likelihood that the moving air is near the surfaces to be dried, further improving drying time. Further still, the ability to pull in less humid air during the evacuation stage provides less humid air for the recirculation stage. This less humid air is better able to evaporate the surface moisture compared to the more humid air that was evacuated. By improving drying times, there is less time facing the risk of slipping on wet surfaces and less time for mold, mildew, and other organisms to grow.

The above examples are in no way intended to limit the scope of the present invention. It will be understood by those skilled in the art that while the present disclosure has been discussed above with reference to exemplary embodiments, various additions, modifications, and changes can be made thereto without departing from the spirit and scope of the inventions, some aspects of which are set forth in the following claims.

What is claimed:

1. A method of evacuating air from a bathroom, the method comprising:

providing the bathroom with an air inlet to allow air directly into the bathroom from an adjacent room, the air inlet including an inlet damper for selectively opening and closing the air inlet;

providing the bathroom with a bathroom air outlet, separate from the air inlet, configured to receive air from the bathroom;

providing the bathroom with a first air outlet configured to emit the air from the bathroom air outlet outside of the bathroom, the first air outlet including an outlet damper for selecting opening and closing the first air outlet;

providing the bathroom with a second air outlet configured to emit the air from the bathroom air outlet back into the bathroom;

providing a fan to selectively pull the air through the bathroom air outlet and push the air through the first air outlet or the second air outlet;

providing a switch operatively coupled to the inlet damper, the outlet damper, and the fan; and selectively operating the switch to:

simultaneously open the inlet damper, open the outlet damper, and turn on the fan;

simultaneously close the inlet damper, close the outlet damper, and turn off the fan; and simultaneously close the inlet damper, close the outlet damper, and turn on the fan.

2. An air circulation and ventilation system for an enclosure, the system comprising:

a housing including:

an intake open to the enclosure;

a first outlet in communication with the intake and configured to emit air from the intake outside of the enclosure, the first outlet including an outlet damper having a closed configuration in which the outlet damper closes the first outlet and an open configuration in which the outlet damper opens the first outlet;

a second outlet in communication with the intake and configured to emit the air from the intake back into the enclosure; and a fan having an off state in which the fan is idle and an on state in which the fan is configured to draw the air from the enclosure through the intake;

a port remote to the housing and configured to allow air from outside of the enclosure into the enclosure, the port having a port damper having a closed configuration in which the port damper closes the port and an open configuration in which the port damper opens the port; and a switch operably coupled to the fan, the outlet damper, and the port damper, the switch having:

a first position in which the fan is in the off state, the outlet damper is in the closed configuration, and the port damper is in the closed configuration;

a second position in which the fan is in the on state, the outlet damper is in the open configuration, and the port damper is in the open configuration; and a third position in which the fan is in the on state, the outlet damper is in the closed configuration, and the port damper is in the closed configuration.

3. The system according to claim 2, further comprising a port fan adjacent the port damper having an off state in which the port fan is idle and an on state in which the port fan is configured to draw the air into the enclosure through the port.

4. The system according to claim 3, wherein the port fan is operably coupled the switch such that in the first and third positions of the switch the port fan is in the off state and in the second position of the switch the port fan is in the on state.

5. The system according to claim 2, wherein the enclosure is a bathroom.

6. The system according to claim 2, further comprising a controller in communication with the switch, the controller comprising at least one of a timer, a programmed processor, a manual switch, or a humidity sensor for selectively controlling the position of the switch.

7. The system according to claim 6, wherein the controller includes a humidity sensor and is configured to change the switch the first position to the second position when a humidity level within the enclosure exceeds a first threshold or when there is a spike in humidity.

8. The system according to claim 7, wherein the controller is configured to change the switch from the second position to the third position when the humidity level within the enclosure drops below a second threshold that is below the first threshold.

9. The system according to claim 2, wherein the second outlet includes at least one of louvers, baffles, a grate, a grill, or a nozzle.

10. The system according to claim 2, wherein the housing further comprises an air conditioner in communication with the intake and the second outlet, the air conditioner operably coupled to the switch such that the air conditioner is activated in the third position of the switch to condition the air drawn through the intake prior to returning the air to the enclosure through the second outlet.

11. The system according to claim 10, wherein the air conditioner comprises at least one of an atomizer or a vaporizer for mixing the air with at least one of disinfectants, deodorizers, neutralizers, or air fresheners.

12. The system according to claim 2, wherein the housing does not include a dedicated dehumidifier.

13. The system according to claim 2, wherein the housing does not include a heater.

14. The system according to claim 2, wherein the enclosure is a room having ceiling and walls extending perpendicular to the ceiling.

15. The system according to claim 14, wherein the housing is secured to the ceiling and the port passes through one of the walls.

16. The system according to claim 15, wherein the one of the walls is an interior wall such that the port is in communication with a room adjacent the enclosure.

17. The system according to claim 15, wherein the one of the walls is an external wall such that the port is in communication with an external environment.

18. An air circulation and ventilation system for a room having a ceiling and walls extending perpendicular to the ceiling, the system comprising:

a housing secured to the ceiling including:

an intake open to the room;

a first outlet in communication with the intake and configured to emit air from the intake outside of the room, the first outlet including an outlet damper having a closed configuration in which the outlet damper closes the first outlet and an open configuration in which the outlet damper opens the first outlet;

a second outlet in communication with the intake and configured to emit the air from the intake back into the room; and a fan having an off state in which the fan is idle and an on state in which the fan is configured to draw the air from the room through the intake;

a port passing through one of the walls of the room and configured to allow air from outside of the room into the room, the port having a port damper having a closed configuration in which the port damper closes the port and an open configuration in which the port damper opens the port; and a switch operably coupled to the fan, the outlet damper, and the port damper, the switch having:

a first position in which the fan is in the off state, the outlet damper is in the closed configuration, and the port damper is in the closed configuration;

a second position in which the fan is in the on state, the outlet damper is in the open configuration, and the port damper is in the open configuration; and a third position in which the fan is in the on state, the outlet damper is in the closed configuration, and the port damper is in the closed configuration.

19. The system according to claim 18, further comprising a port fan adjacent the port damper having an off state in which the port fan is idle and an on state in which the port fan is configured to draw air into the room through the port.

20. The system according to claim 19, wherein the port fan is operably coupled the switch such that in the first and third positions of the switch the port fan is in the off state and in the second position of the switch the port fan is in the on state.

* * * * *